US006722069B1

(12) United States Patent
Lanier

(10) Patent No.: US 6,722,069 B1
(45) **Date of Patent: *Apr. 20, 2004**

(54) CURVED PANEL ASSEMBLIES AND METHODS OF ASSEMBLY THEREOF

(76) Inventor: Addison Lanier, RR8 Site 12 Comp 12, Lethbridge, Alberta (CA), T1J 4P4

( * ) Notice: Subject to any disclaimer, the term of this patent is extended or adjusted under 35 U.S.C. 154(b) by 108 days.

This patent is subject to a terminal disclaimer.

(21) Appl. No.: 10/069,775

(22) PCT Filed: Aug. 31, 2000

(86) PCT No.: PCT/CA00/01009

§ 371 (c)(1),
(2), (4) Date: Feb. 28, 2002

(87) PCT Pub. No.: WO01/16922

PCT Pub. Date: Mar. 8, 2001

Related U.S. Application Data

(63) Continuation-in-part of application No. 09/387,761, filed on Sep. 1, 1999, now Pat. No. 6,276,084.

(51) Int. Cl.[7] ..... G09F 7/02
(52) U.S. Cl. ..... 40/611.1; 40/738
(58) Field of Search ..... 40/124.07, 611, 40/650, 738, 745, 761, 762

(56) References Cited

U.S. PATENT DOCUMENTS

| | | | | |
|---|---|---|---|---|
| 3,041,761 A | * | 7/1962 | Knox | 40/738 |
| 3,041,762 A | * | 7/1962 | Knox | 40/738 |
| 3,952,437 A | | 4/1976 | Mitchell | |
| 5,619,816 A | | 4/1997 | Ellison | 40/737 |
| 6,276,084 B1 | | 8/2001 | Lanier | |

FOREIGN PATENT DOCUMENTS

| | | |
|---|---|---|
| DE | 29811222 | 5/1999 |
| EP | 707821 A2 | 4/1996 |
| FR | 9707936 | 6/1997 |
| JP | 8256887 | 8/1996 |
| WO | 9534059 | 12/1995 |

* cited by examiner

*Primary Examiner*—Joanne Silbermann

(57) ABSTRACT

A curved panel assembly useful e.g. as a sign holder, has upper and lower elongate curved abutment members each with an elongate concave rear side, and backing sheet retainers extending rearwardly from the concave side at opposite ends of the concave side, the backing sheet retainers having a predetermined spacing from one another. A backing sheet has first opposite marginal edge portions facing and abutting the concave rear sides of the abutment members, the latter being rearwardly open behind the edge portions to allow the backing sheet to be displaced to and fro, and second opposite marginal edge portions retained by the backing sheet retainers. The first opposite marginal edge portions have a length greater than the predetermined spacing of the backing sheet retainers and the backing sheet is sprung into abutment against the rear sides of the abutment members with the second opposite marginal edge portions retained by the backing sheet retainers.

26 Claims, 20 Drawing Sheets

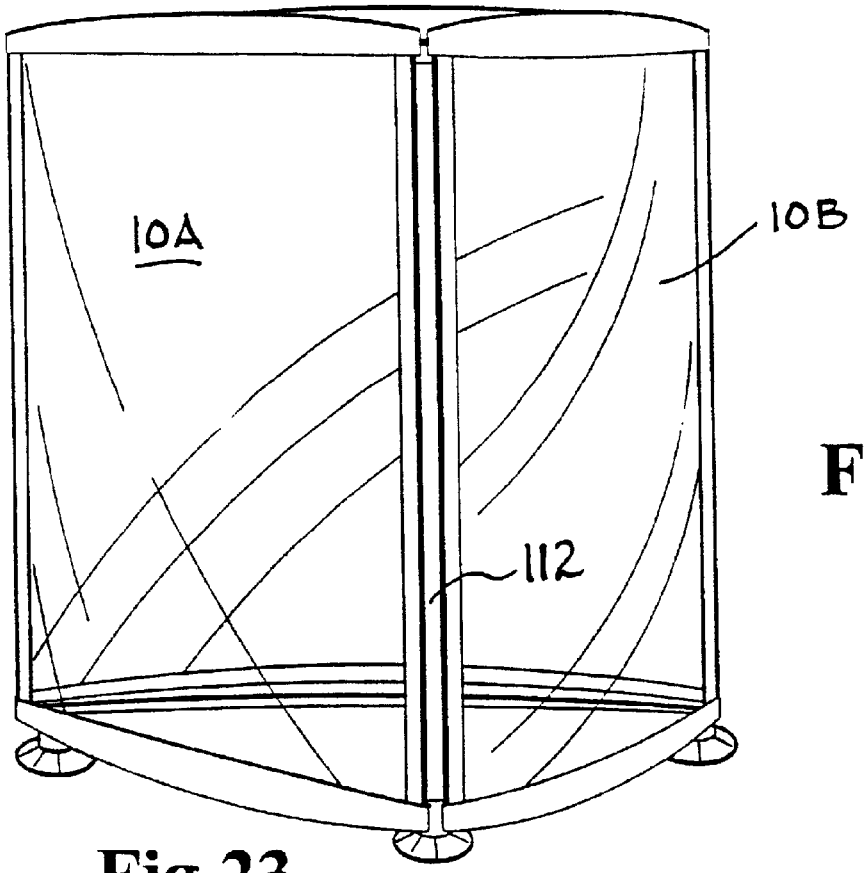
Fig.23
Fig.24
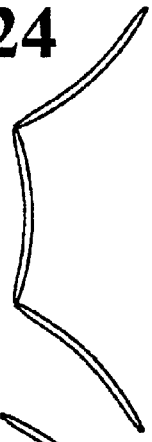
Fig.25
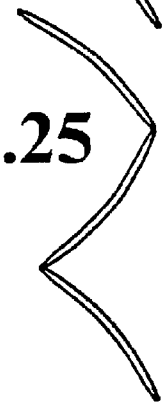
Fig.26
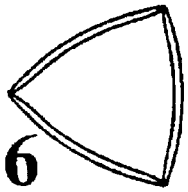
Fig.27
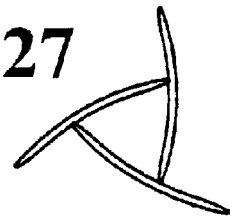
Fig.28
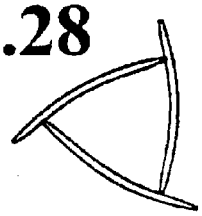

CURVED PANEL ASSEMBLIES AND METHODS OF ASSEMBLY THEREOF

This application is a continuation-in-part of application Ser. No. 09/387,761 filed Sep. 1, 1999, now U.S. Pat. No. 6,276,084.

TECHNICAL FIELD

The present invention relates to curved panel assemblies and to methods of assembling curved panel assemblies, and is useful in particular, but not exclusively, for curved panel assemblies for use as sign holders which are self-supporting on the ground, arranged together in various groupings or mounted on a wall, post or other support.

BACKGROUND ART

In U.S. Pat. No. 3,952,437, issued Apr. 27, 1976 to Robert W. Mitchell, there is disclosed a display frame for photographs or other displays which enables pictures to be displayed in a curved position. More particularly, the aforesaid patent discloses a display frame comprising spaced upper and lower plates having shaped edges formed with curved slots for receiving the picture and a backing sheet. Spacers are provided between the plates, and the plates are drawn towards one another by means of a rubber band or the like.

It is, however, a disadvantage of this prior display frame that the assembly of the frame is complicated, since the picture must somehow be inserted into the slots of the upper and lower plates, apparently while the latter are being drawn together by the rubber band or the like and while the spacers are also being fitted to the vertical edges of the picture.

DISCLOSURE OF INVENTION

According to the present invention, there is provided a curved panel assembly which has upper and lower elongate curved abutment members, each having an elongate curved rear side, with backing sheet retainers extending rearwardly from the concave side at opposite ends of the concave side, the backing sheet retainers having a predetermined spacing from one another. A backing sheet has first opposite marginal edge portions facing and abutting the concave rear sides of the abutment members, the latter being rearwardly open behind the first opposite marginal edge portions, and second opposite marginal edge portions retained by the backing sheet retainers. The first edge portions each have a length greater than the predetermined spacing of the backing sheet retainers.

In use, the second marginal edge portions of the backing sheet are inserted between the backing sheet retainers and the concave rear sides of the abutment members, with the backing sheet concavely curved at its side facing the abutment members and spaced from the concave rear sides of the abutment members. The backing sheet is then pressed towards the abutment members, to thereby spring the backing sheet into engagement into the backing sheet retainers and into abutment against the concave rear sides of the abutment members. The backing sheet then serves as a spacer for the abutment members.

The assembly and disassembly of the present curved panel assembly are thus effected by simply pressing the backing sheet towards or away from the concave rear sides of the abutment members, so that the present curved panel assembly can be easily and quickly assembled at the location at which it is to be used.

BRIEF DESCRIPTION OF THE DRAWINGS

The present invention will be more readily understood from the following description of a preferred embodiment thereof given, by way of example, with reference to the accompanying drawings, in which:

FIG. 23 shows a diagrammatic view, in perspective, of an assembly of three curved panel assemblies cited that as of FIG. 1;

FIGS. 24 through 28 show plan views of possible variations of the assembly of curved panel assemblies of FIG. 23;

DESCRIPTION OF THE BEST MODE

Figure 1:
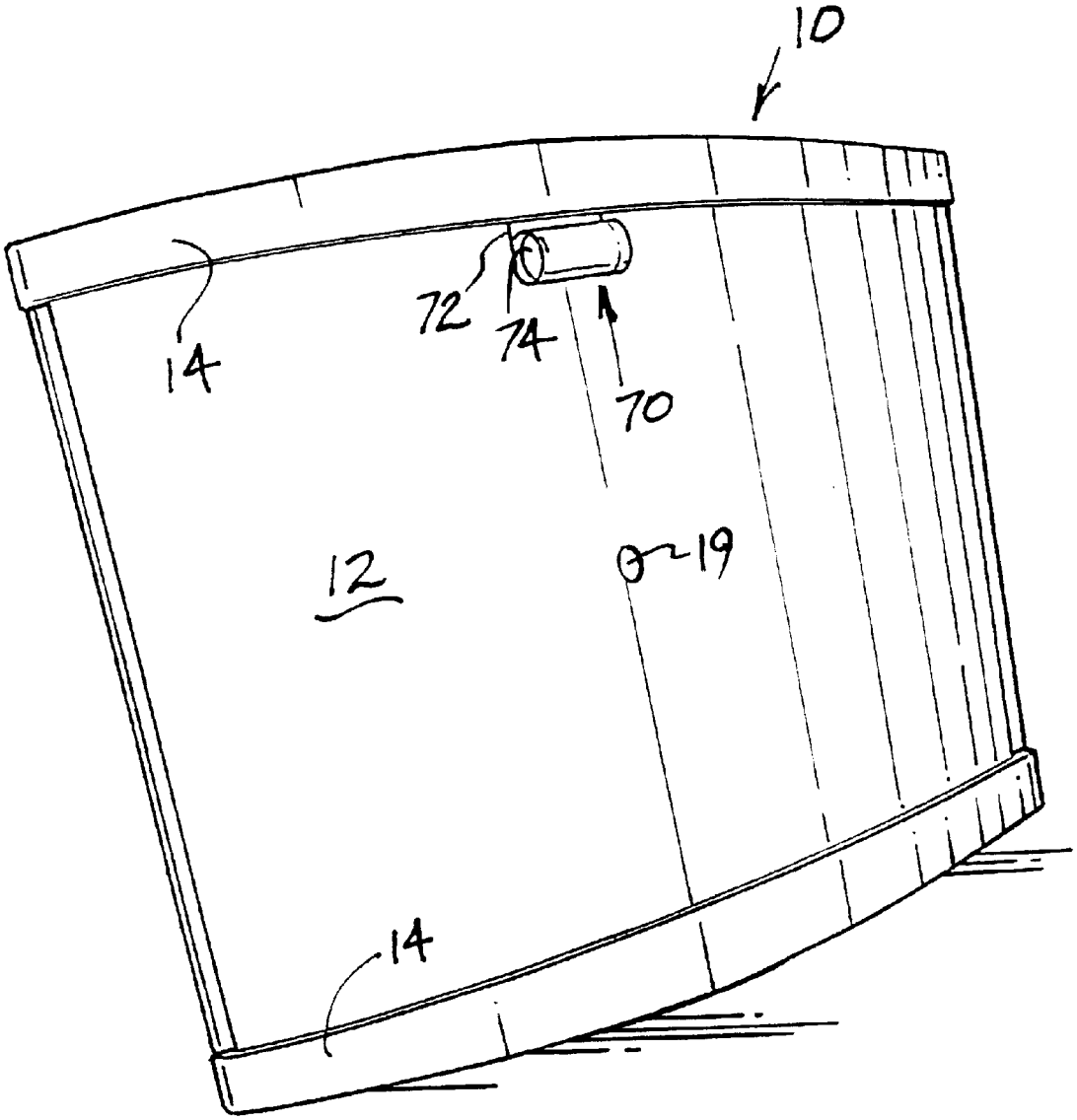
FIG. 1 shows a view in perspective of a curved panel assembly embodying the present invention, from the front of the curved panel assembly.

In FIGS. 1 through 10 of the accompanying drawings, there is illustrated a curved panel assembly according to a first embodiment of the present invention, which is in the form of a sign holder and which is indicated generally by reference numeral 10. The curved panel assembly 10 comprises a backings sheet 12 assembled with identical upper and lower elongate curved abutment members 14. The abutment members 14 each have a concave rear side 16, at opposite ends of which backing sheet retainers 18 extend rearwardly from the concave rear side 16. The backing sheet retainers 18 have a predetermined spacing S (FIG. 4A) from one another and the backing sheet 12 has a central circular finger-hole 19 to facilitate carrying of the curved panel assembly 10.

The backing sheet 12 has first opposite marginal edge portions 20 facing and abutting the concave rear sides 16 of the abutment members 14 and second opposite marginal edge portions 22 retained by the backing sheet retainers 18.

Figure 3:
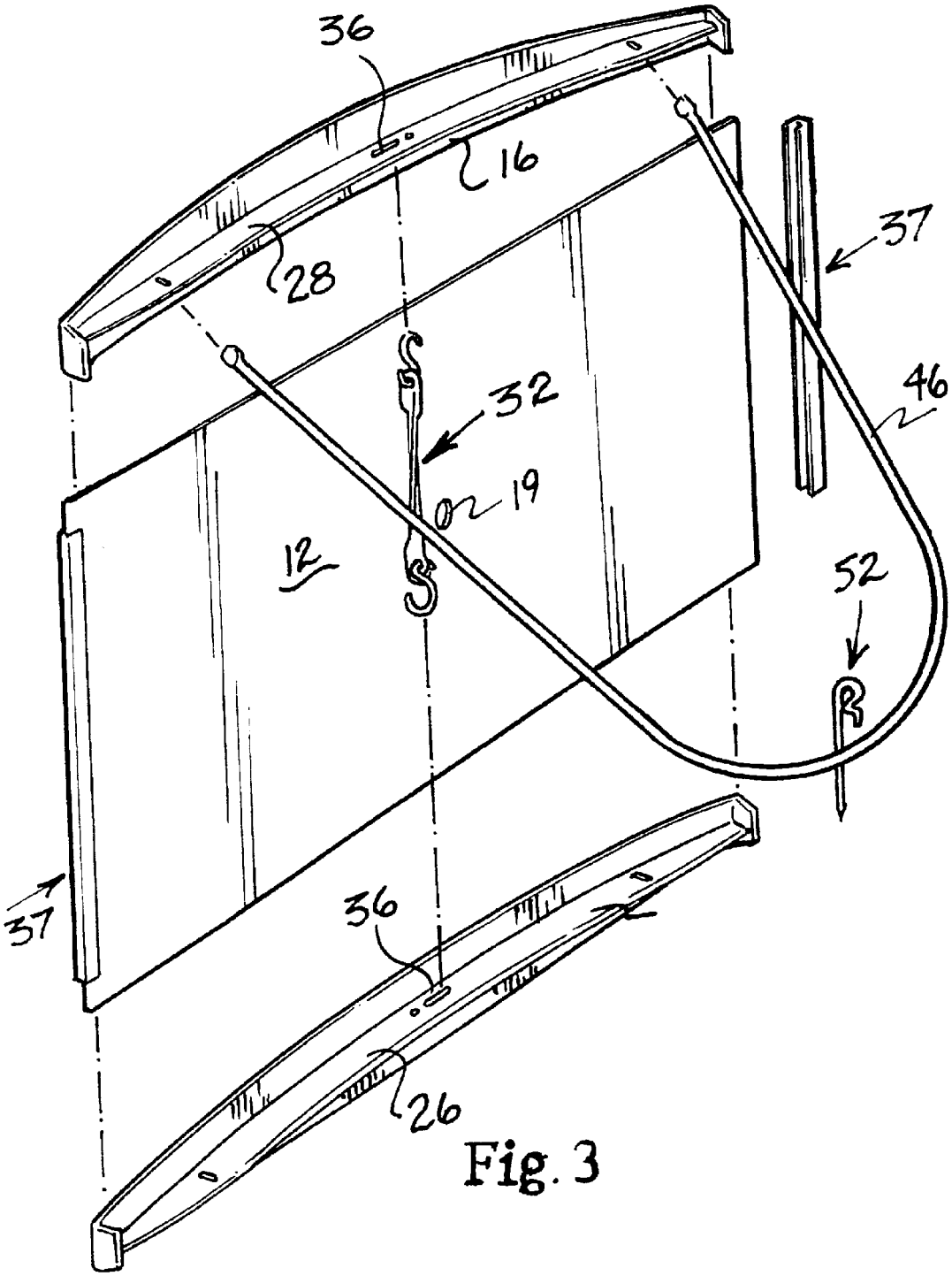
FIG. 3 shows a view similar to FIG. 2 but with the components of the curved panel assembly separated from one another.
Figure 4A:
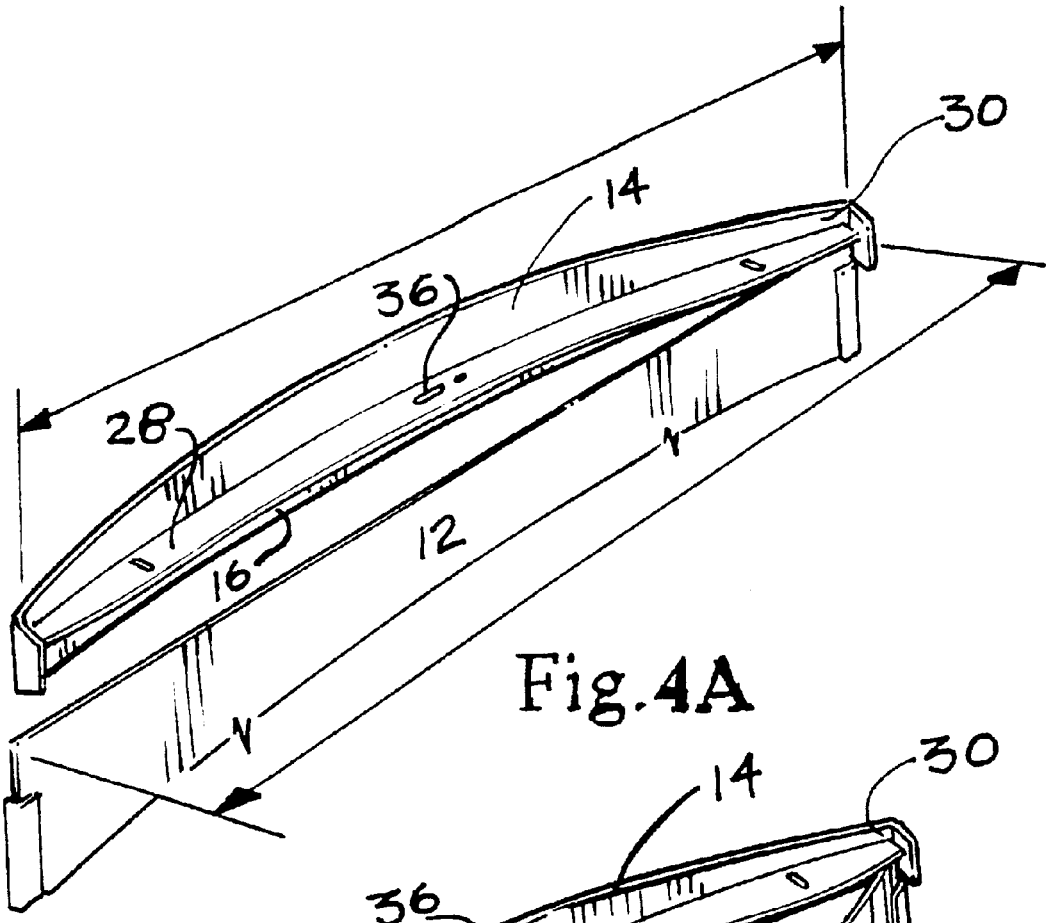
FIGS. 4A, 4B and 4C show successive steps in the assembly of the curved panel assembly of FIG. 1.
Figure 4B:
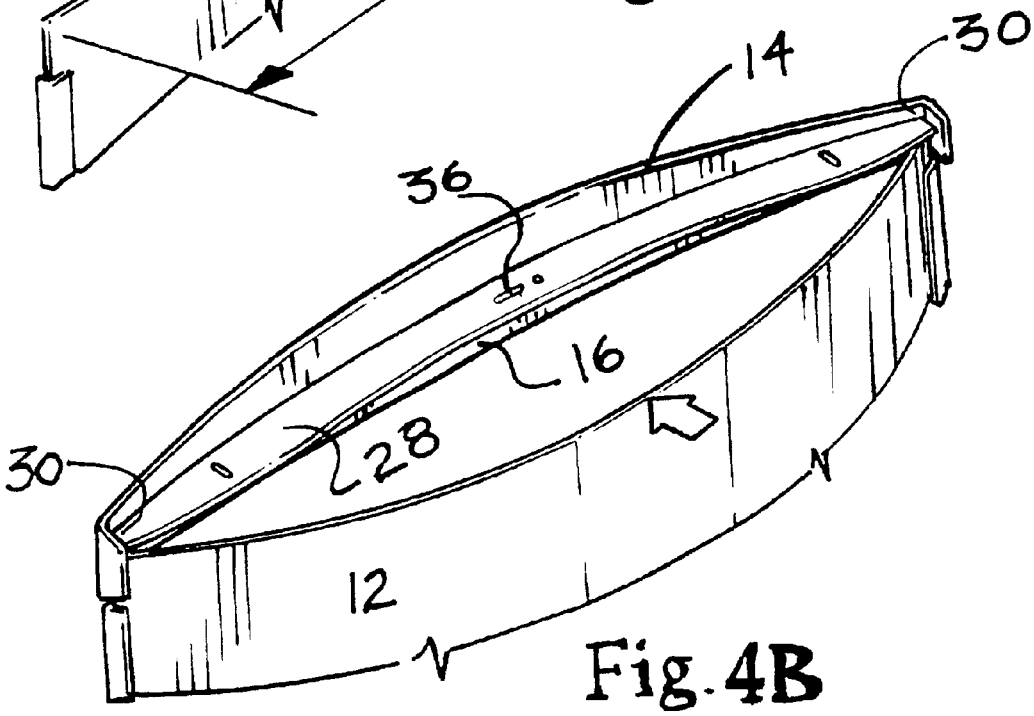

The first opposite marginal edge portions 20 each have a length L (FIG. 4A) greater than the predetermined spacing S of the backing sheet retainers 18 as shown in FIGS. 3, 4A and 4B.

Figure 2:
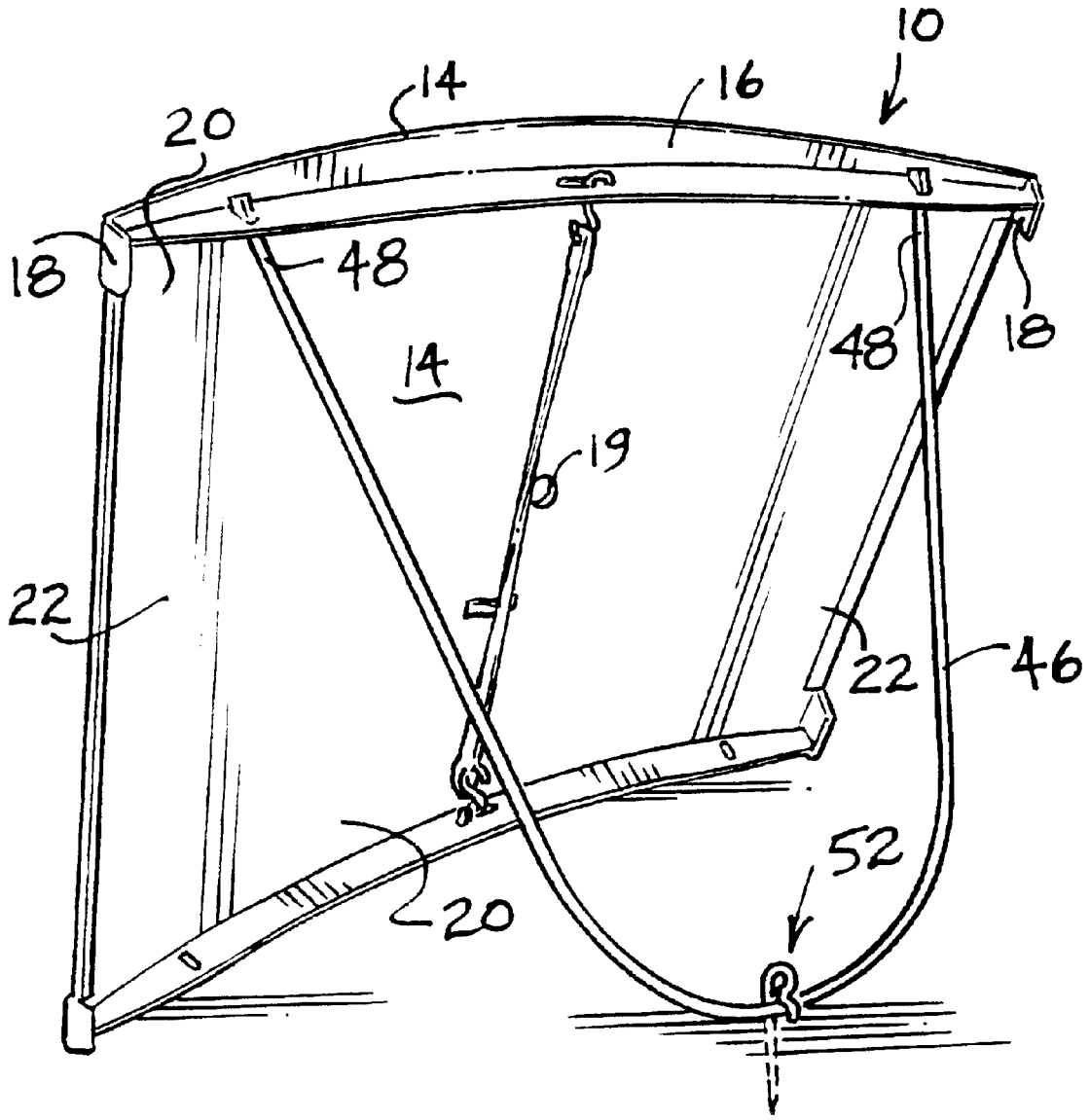
FIG. 2 shows a view in perspective of the curved panel assembly of FIG. 1, but taken from the rear of the curved panel assembly.

Therefore, when the backing sheet 12 is assembled with the abutment members 14, one of the edge portions 22 is inserted into one of the backing sheet retainers 18 of the upper abutment member 14, as shown in FIG. 4A, and also into the corresponding backing sheet retainer 18 of the lower abutment member 14. The opposite edge portion 22 of the backing sheet 12 is then inserted into this retainer 18 at the opposite ends of the abutment members 14. This causes the backing sheet 12 to assume a curved shape, with the front side of the backing sheet 12 being convex towards the convex rear sides 16 of the abutment members 14. By pressing against the rear side of the backing sheet 12, the backing sheet 12 is sprung into the position, relative to the abutment members 14, in which it is shown in FIGS. 1 and 2 and in which the front face of the backing sheet 12 is convex and adjacent the concave rear sides 16 of the abutment members 14. By pressure of the edge portions 22 of the backing sheet 12 against the backing sheet retainers 18, the two abutment members 14 and the backing sheet 12 are thereby retained or locked together as an assembly, which can, for example, be lifted, without falling apart, by gripping the upper abutment member.

Figure 4C:
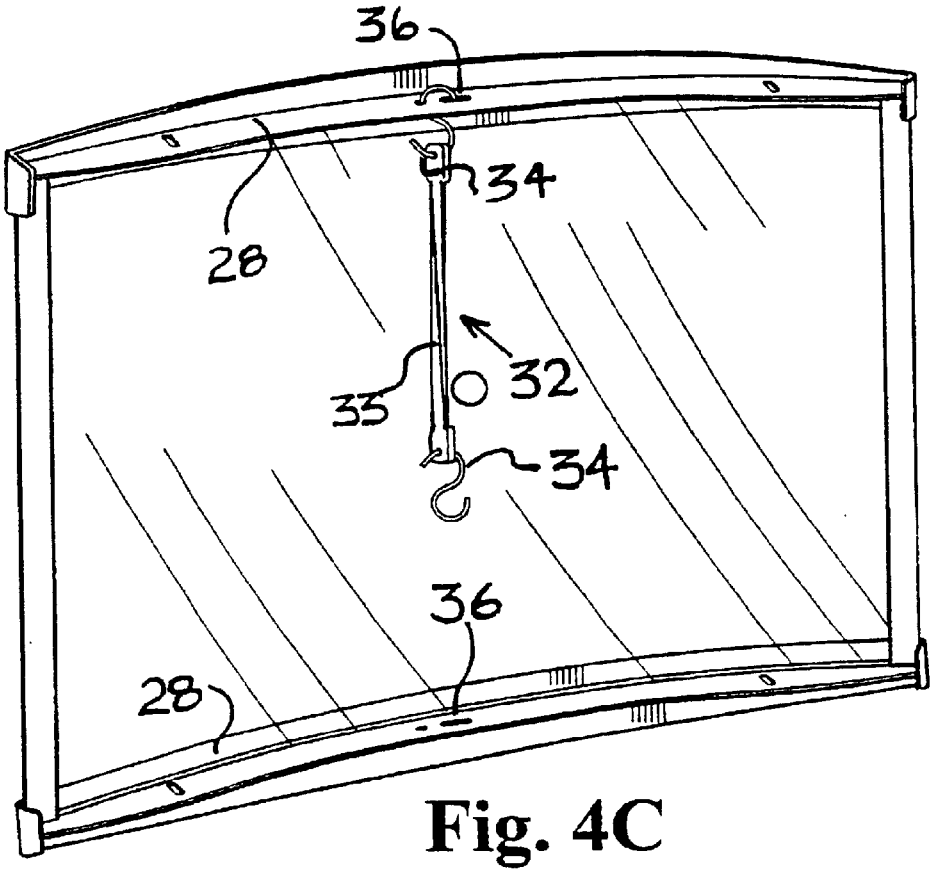

A resilient retainer, indicated generally by reference numeral 32 and shown partly attached to this assembly in FIG. 4C, is then provided as described in greater detail below.

Figure 7:
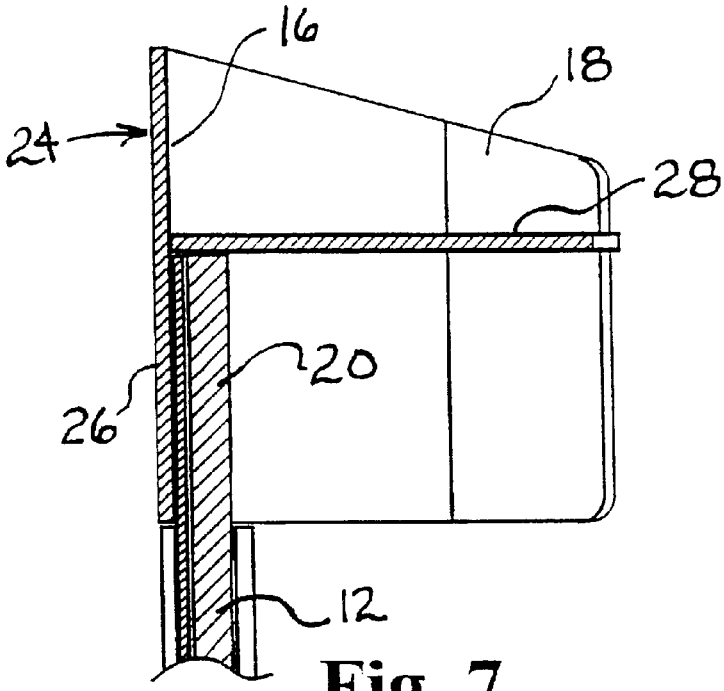
FIG. 7 shows a view taken in cross-section along the line 7—7 of FIG. 6.

The abutment members 14 have a T-shaped cross-section, as shown in FIG. 7, formed by an elongate curved front plate indicated generally by reference numeral 24 having a convex front side 26, and a flat flange or plate 28 projects rearwardly from the concave rear side 16. The marginal edge portions 20 of the backing sheet 12 abut the flat flanges 28 of the abutment members 14, so that the backing sheet 12 is accommodated between and retained by the flat flanges 28. The flat flanges 28 thus form abutments extending rearwardly of the abutment members 14 past the first opposite marginal edge portions 20 of the backing sheet 12. The abutment members 14 are rearwardly open and unobstructed behind the first opposite marginal edge portions 20 so as to allow the backing sheet 12, and in particular the first opposite marginal edge portions 20, to be displaced to and fro perpendicular to the concave rear side during assembly and disassembly of the curved panel assembly.

The backing sheet retainers 18 comprise end portions of the front plate 24, which are bent to form flanges extending rearwardly from the concave rear sides 16 and, thereby, forming with the concave rear sides 16 of the abutment members 14 pairs of opposed concave recesses 30 at opposite ends of the rear side 16. These opposite concave recesses 30 receive and engage the second opposite marginal edge portions 22 of the backing sheet 12.

The elongate resilient retainer 32 is stretched between the abutment members 14 and comprises a loop 33 of resilient elastomeric material engaged with a pair of S-shaped hooks 34, which are engaged through slots 36 in the flat flanges 28 of the two abutment members 14 for more securely holding together the backing sheet 12 and the abutment members 14.

The backing sheet 12 is provided with elongate edge covers or clips, indicated generally by reference numerals 36, which are plastic extrusions and which each extend along and are engaged over the second opposite marginal edge portions 22 of the backing sheet 12 with opposite ends of the covers 37 extending between the backing sheet 12 and the abutment members 14.

Figure 5:
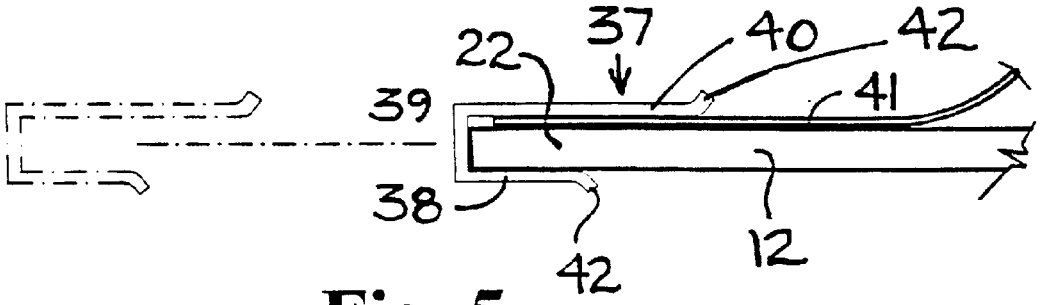
FIG. 5 shows a broken-away view of one marginal edge portion of a backing sheet forming part of the curved panel assembly of FIG. 1.
Figure 6:
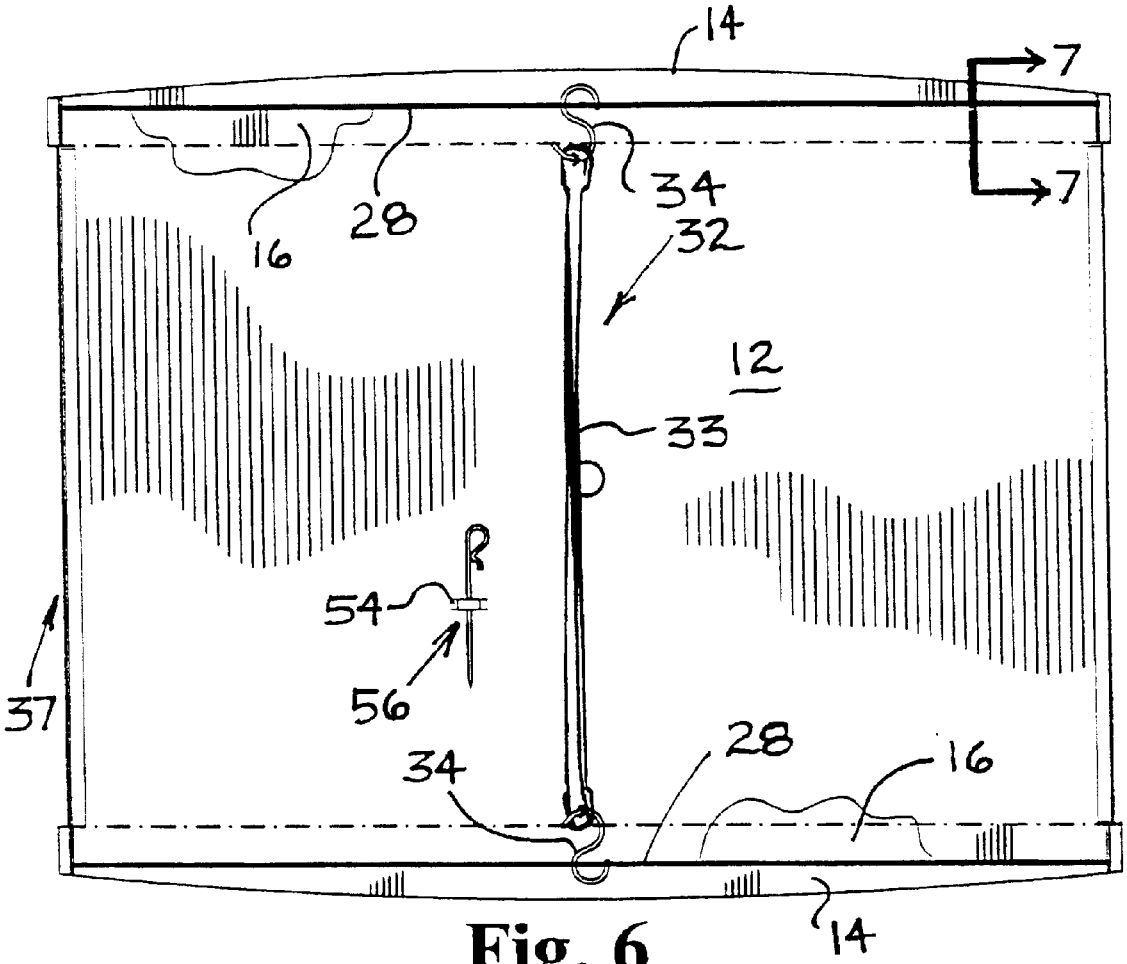
FIG. 6 shows a view in rear elevation of the curved panel assembly of FIG. 1.

As shown in FIG. 5, in the present embodiment of the invention each of these edge covers 36 comprises an edge portion or flange 38 at the rear of the backing sheet 12, an intermediate portion 39 and a further edge portion or flange 40, which is connected by the intermediate portion 39 to the edge portion 38 and which extends onto and retains a display sheet 41 at the front of the backing sheet 12. The edge portions 38 and 40 have curved outturned edges 42 to enable the edge covers 37 to be slid onto the edges of the backing sheet 12 and the display sheet 41 by resiliently spreading apart the edge portions 38 and 40.

The assembly of the backing sheet 12 and the two abutment members 14, with the edge covers 37, and the resilient retainer 32, can be supported at an inclination on the ground, as shown in FIG. 2, by means of a U-shaped support rod 46 having ends 48 engageable in slots 50 in the flat flanges 28 of one of the abutment members 14. The lower edge of the lowermost abutment member 14 is curved so as to lie flush with the ground.

Figure 8A:
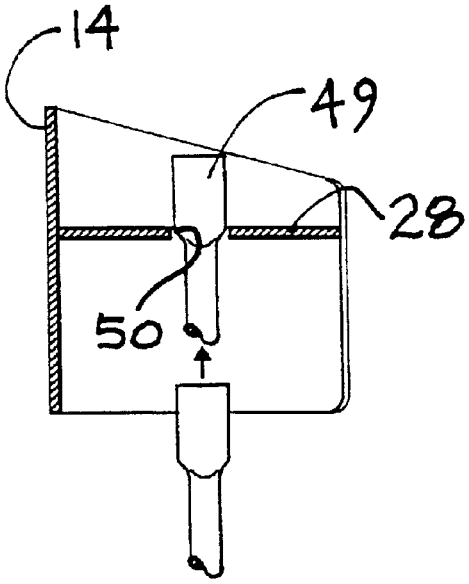
FIGS. 8A and 8B show views taken in cross-section through part of a curved panel assembly of FIG. 1 during and after, respectively the engagement of a support rod.
Figure 8B:
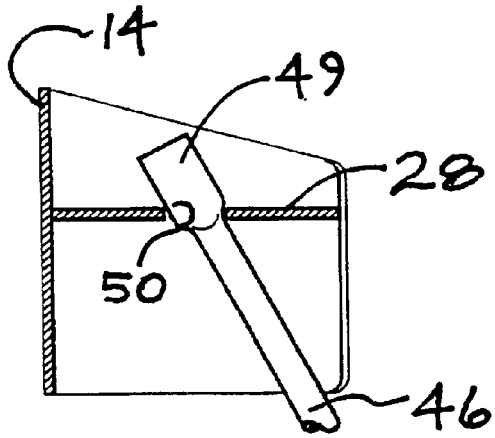

The support rod 48 has, at each end, a flattened end portion 49 which, as shown in FIGS. 8A and 8B, is inserted in the direction of arrow A in FIG. 8A through a respective one of a pair of slots in the flange 28 of the uppermost abutment member 14, of which one slot is shown in FIGS. 8A and 8B and is indicated by reference numeral 50. The rod 46 is then pivoted in the direction of arrow A to engage the flattened end portion 49 with the edges of the slot 50 as shown in FIG. 8B. Also, the ends 48 of the rod 46 have to be pressed together to enable them to be inserted into the slots in the flange 28 so that when released, the ends press resiliently against the edges of the slots.

Figure 9:
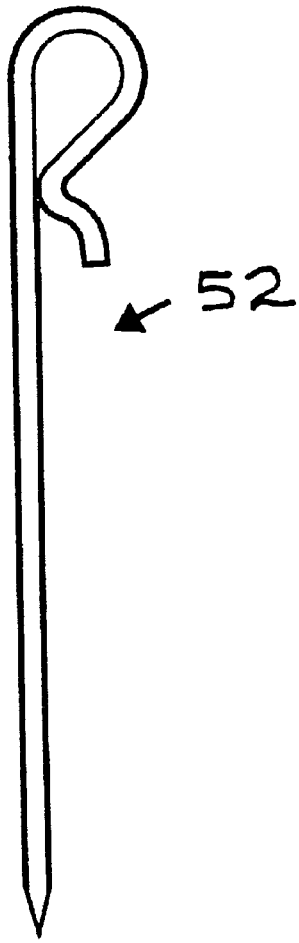
FIG. 9 shows a view in side elevation of a retainer performing part of the curved panel assembly of FIG. 1.

The support rod 46 may, if required, be pegged to the ground by means of a retainer peg which is indicated generally by reference numeral 52 in FIG. 2 and shown in greater detail in FIG. 9, and which, when not in use, is secured to the back of the backing sheet by means of a retainer strip 54 (FIG. 6) adhered to the backing sheet 12.

Referring again to FIG. 1, the curved panel assembly 10 is provided with a cylindrical tube indicated generally by reference numeral 70 for holding business cards (not shown) when the curved panel assembly is used e.g. for realtors' signage. The tube 70 has flap 72 tucked between the upper abutment member 14 and the backing sheet 12 for retaining the tube 70 in position, and a removable end cap 74.

Figure 10:
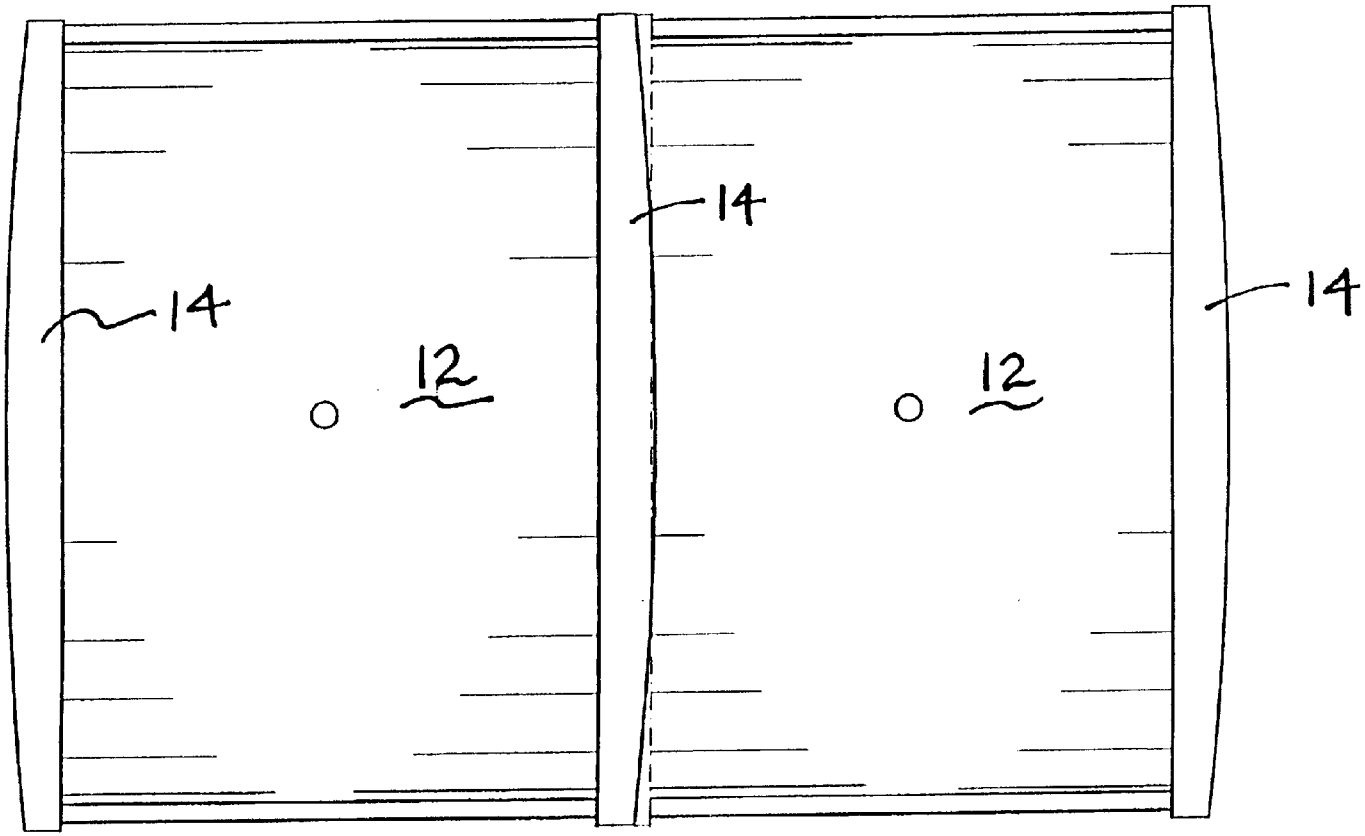
FIG. 10 shows a view in front elevation of an extended version of the curved panel assembly of FIGS. 1 through 7.
Figure 11:
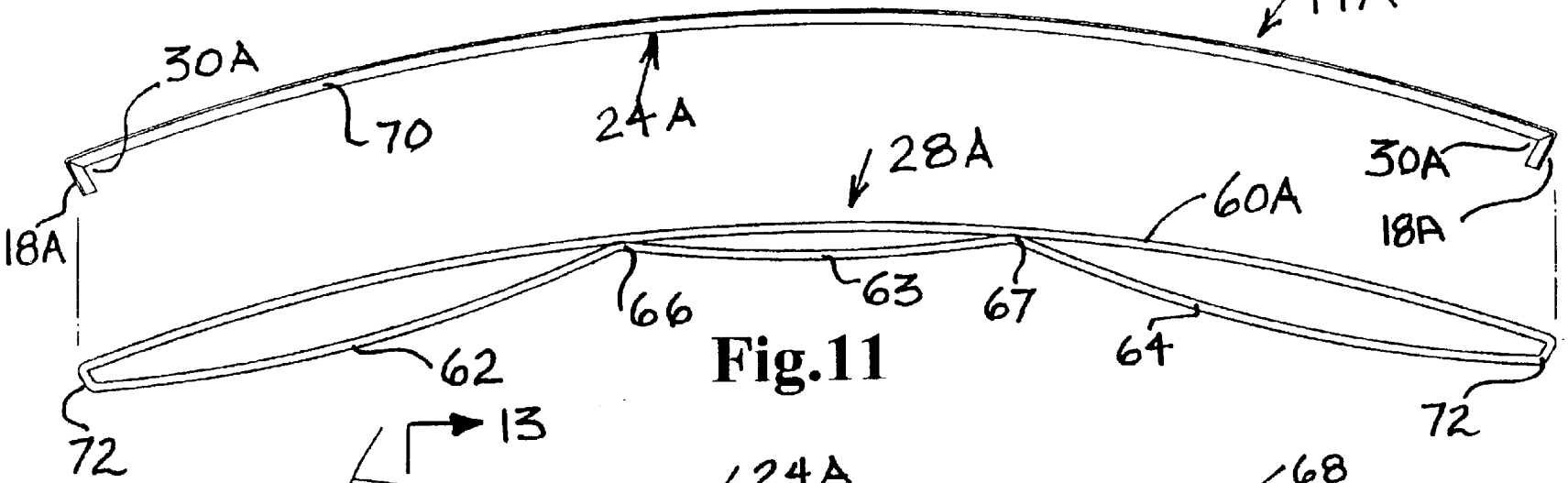
FIG. 11 shows a plan view of an abutment member forming part of a curved panel assembly according to a second embodiment of the invention.
Figure 13:
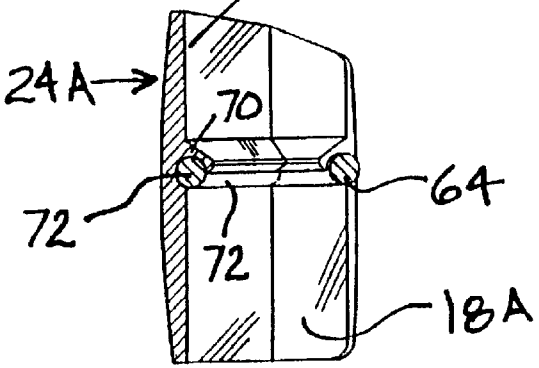
FIG. 13 shows a view taken in cross-section along the line 13—13 of FIG. 12.
Figure 12:
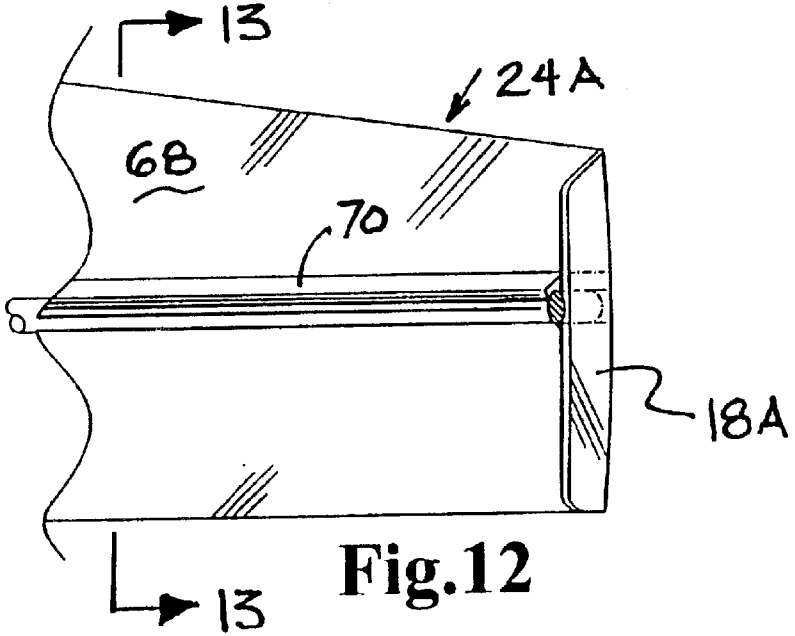
FIG. 12 shows a broken-away view in rear elevation of the abutment member of FIG. 11.
Figure 15B:
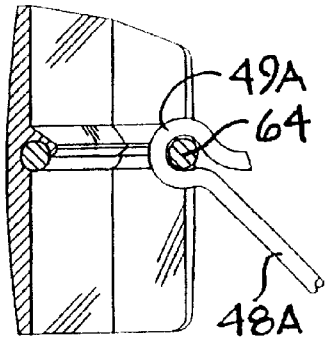
FIGS. 15A and 15B show, respectively, views taken in cross-section along the line 15—15 of FIG. 14 with an associated component omitted and included.
Figure 15A:
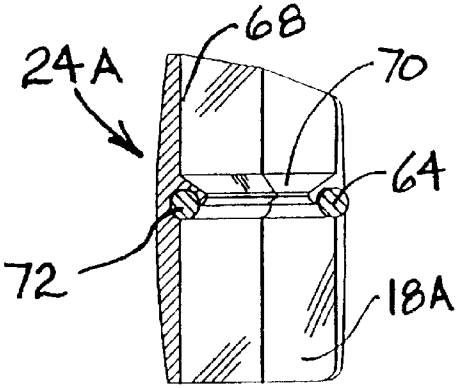

As shown in FIGS. 1 through 7, the curved panel assembly 10 comprises only two abutment members 14 and one backing sheet 12. However, as shown in FIG. 10, a second backing sheet 12 and a third abutment member 14 may be added, together with a further resilient retainer 32 (not shown), in order to extend the curved panel assembly 10 and, thereby to present an enlarged curved panel assembly. Likewise, a greater number of backing sheets and abutment members may be assembled to present an even longer curved panel assembly.

Also, instead of mounting the curved panel assembly 10 on the ground with the abutment members 14 extending horizontally as shown in FIGS. 1 and 2, the support rod 46 may be removed and the curved panel assembly 10 may then be rotated through 90 degrees so that the abutment members 14 extend vertically. The backing sheet retainers 18 at the upper ends of the two abutment members 14 may then be employed as hooks for engagement over a suitable ledge or other support (not shown) so as to suspend the curved panel assembly, e.g. from a wall.

In FIGS. 11 through 15B of the drawings, there is illustrated a modified abutment member, indicated generally by reference numeral 14A. In this second embodiment of the invention, a pair of the abutment members 14A replace the abutment members 14 of FIG. 1.

The abutment member 14A of FIGS. 11 through 15 comprises two components, namely an elongate front plate indicated generally by reference numeral 24A, which corresponds to the front plate 24 of the embodiment of FIGS. 1 to 10, and a backing sheet abutment indicated generally by reference numeral 28A, which corresponds to the abutment flange 28.

The backing sheet abutment 28A is formed of a length of metal wire which is bent to form curved front portion 60 and three curved rear portions 62, 63 and 64, which are welded to the front portion 60 at locations 66 and 67 and which serve to reinforce the front portion 60.

The front plate 24A has a concave rear side 68 formed with a rib 70 extending the length of the front plate 24A, and the rib 70 is formed with a rearwardly open recess 72 of circular cross-section for receiving and engaging the curved front portion 60 of the backing sheet abutment 24A.

Opposite end portions of the front plate 24A are bent back to form a pair of backing sheet retainers 18A, corresponding to the backing sheet retainers 18 of the first embodiment and the backing sheet retainers 18A likewise form flanges extending rearwardly from the rear side 68 and forming therewith opposed concave recesses 30A for receiving and engaging the second opposite marginal edge portions 22 of the backing sheet 12. The ribs 70 extend across the backing sheet retainers 18A and receive and engage opposite ends 72 of the backing sheet abutment 24A.

Figure 14:
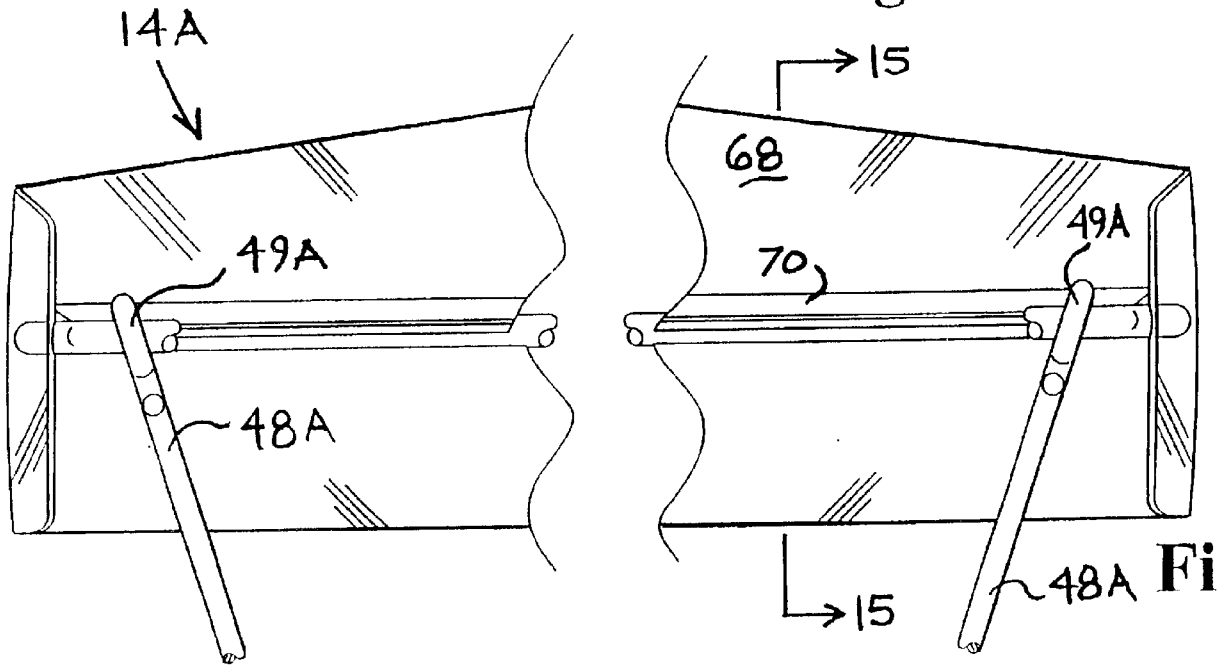
FIG. 14 show a view in rear elevation of parts of the abutment member of FIG. 11 with associated components.

A support rod 48A is releasably secured to the curved portions 62 and 64 of the backing sheet abutment 48A and is similar to the support rod 48 of the first embodiment, except that instead of the flattened end portions 49 of the support rod 48, the support rod 48A is formed with bent end portions 49A which are shaped to engage with the wire of the curved portions 62 and 64 as illustrated in FIG. 14.

The remaining components of the second embodiment of the curved panel assembly according to the present invention are similar to the corresponding components of FIGS. 1 through 10 and are therefore not further described or illustrated.

The backing sheet retainers 18 of the first embodiment are made of stainless steel but other suitable materials, e.g. plastic material, which may be translucent or even transparent, may alternatively be employed.

The backing sheet retainers 18A of the second embodiment are formed of plastic extrusions, which may likewise be translucent or transparent.

Also, the upper and lower edges of the front plates 24 and 24A may be curved, or may alternatively be straight and parallel.

If desired, the resilient retainer 32 may be omitted from the two above-described embodiments of the invention.

Figure 16:
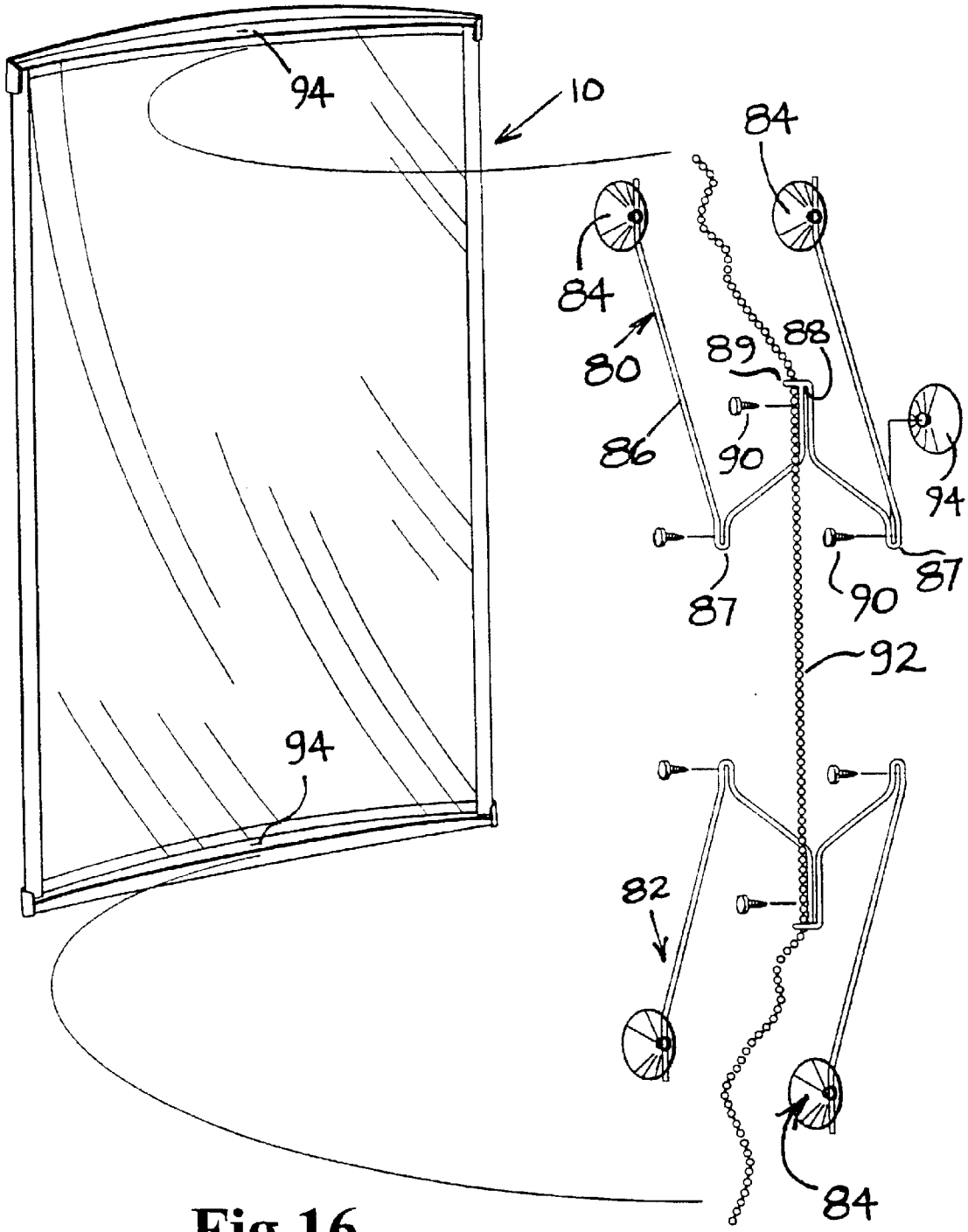
FIG. 16 shows an exploded view, in perspective, of a curved panel assembly according to FIG. 1 provided with a pair of support brackets.

In FIG. 16, the curved panel assembly 10 is shown with a pair of support brackets indicated generally by reference numerals 80 and 82.

The support brackets 80 and 82 each comprise a pair of suction cups 84, which are mounted on free arms 86 of a length of metal rod which is bent so as to form the arms 82 and, also, a rear portion 88. The rear portion 88 and the junctions between the rear portion 88 and the arms 86 form U-shaped portions 87 and 89 which receive screws 90 for securing the brackets 80 and 82 to, for example, a wall or other vertical support (not shown). The arms 86 are inclined vertically and laterally from the rear portions 88 so as to support the suction cups 84 and, thereby, the curved panel assembly 10 at a slight spacing from this vertical support.

Figure 17:
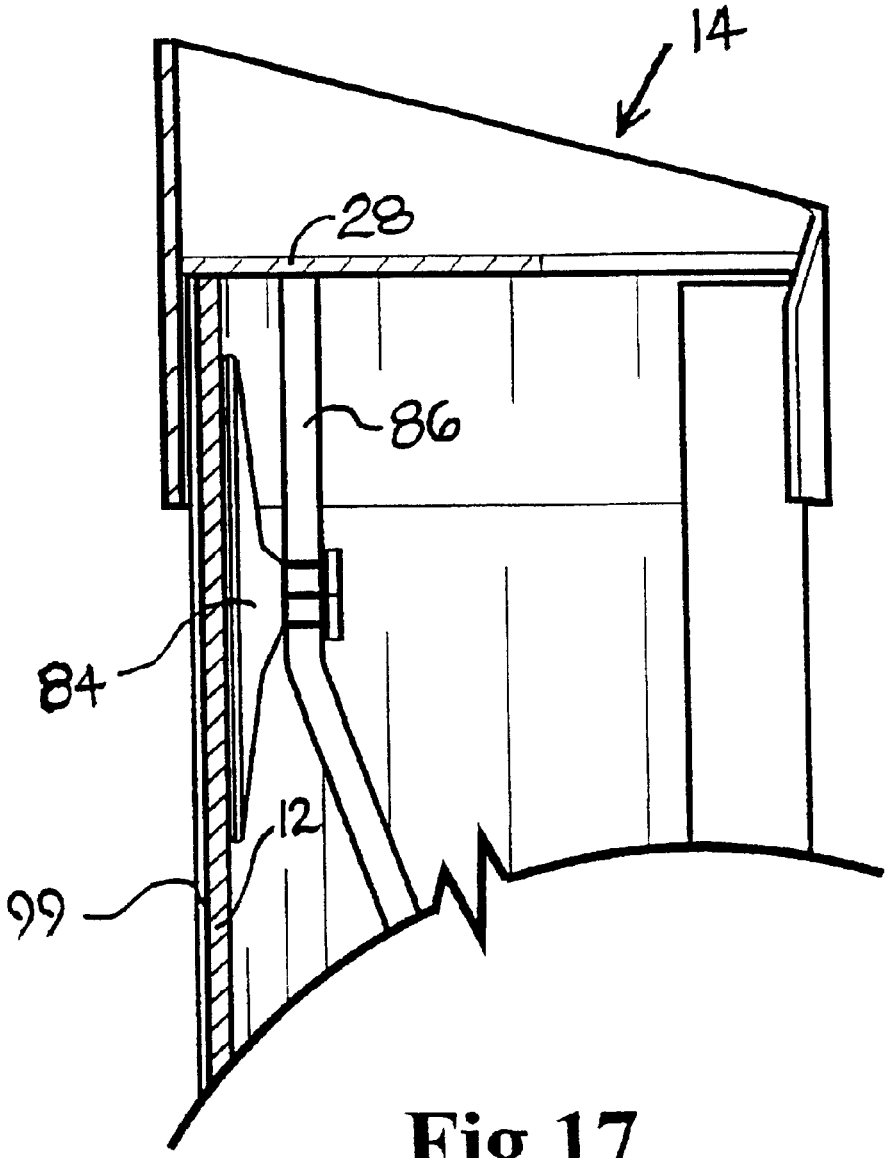
FIG. 17 shows a broken-away view in cross-section through a part of the curved panel assembly of FIG. 16 and a part of one of its support brackets.

As can be seen from FIG. 17, which shows one of the suction cups 84 in engagement with the rear surface of the backing sheet 12, the free end of the arm 86 abuts and thereby, supports the flange 28 of the abutment member 14.

An elongate, flexible retainer in the form of a metal chain 92 extends between the upper and lower abutment members 14, to which it is connected by engagement in keyhole slots 94 in the abutment members 14, and also extends between and in engagement with rear portions 88 of the support brackets 80 and 82 for securely retaining the curved panel assembly 10 in position relative to the support brackets 80 and 82. This flexible retainer may alternatively directly connect the abutment members without engaging the support brackets.

Instead of employing screws 90 to secure the brackets 80 and 82 to the vertical surface, the screws 90 may be replaced by suction cups, one of which is shown in FIG. 16, by way of example, and is indicated reference numeral 94.

Figure 18:
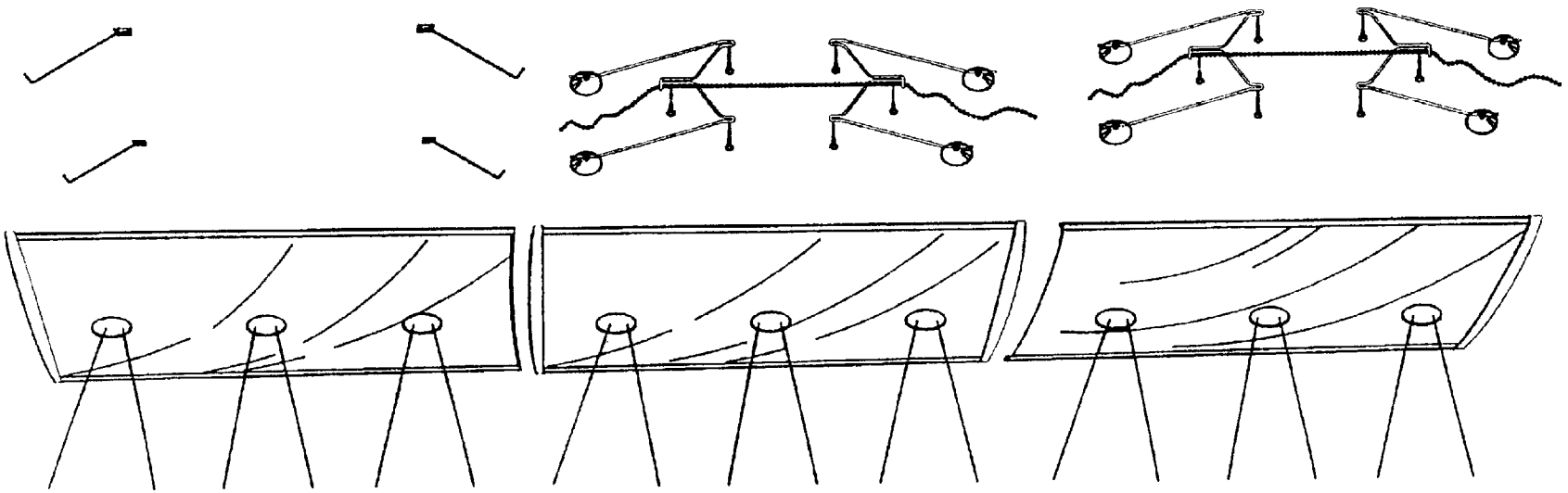
FIG. 18 shows a diagrammatic view of a curved panel assembly being secured by support brackets to a ceiling.

The brackets 80 and 82 may also be employed to secure the curved panel assembly 10 to a horizontal support surface, e.g. a ceiling of a room, as illustrated diagrammatically in FIG. 18, in which three of the backing sheets are being assembled into a curved panel assembly for attachment to overhead support brackets. The backing sheets may be transparent or, as shown in FIG. 18, provided with circular openings 96 to allow the transmission of light downwardly through the backing sheets from overhead lamps (not shown).

Figure 19:
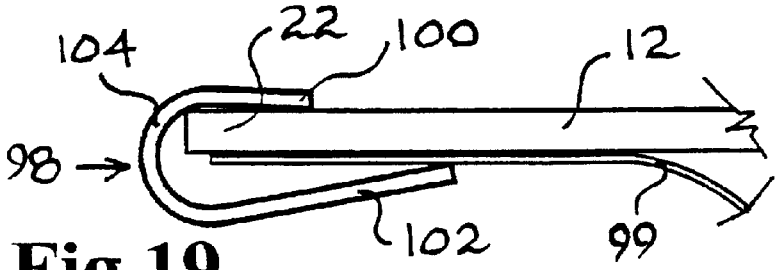
FIGS. 19 through 22 show four different embodiments of metal extrusion reinforcements for engagement with opposite edges of the backing sheet of the curved panel assembly of FIG. 1.

FIG. 19 shows a metal extrusion reinforcement indicated generally by reference numeral 98, having flat flanges 100 and 102 connected by a circularly curved intermediate portion 104, engaged over one of the second opposite modular edge portions 22 of the backing sheet 12 and the edge of a poster 99. This reinforcement 98 extends to the abutment members 14 and serves to rigidify the curved panel or retain the edges of the posters in the panel and poster assembly.

Figure 20:
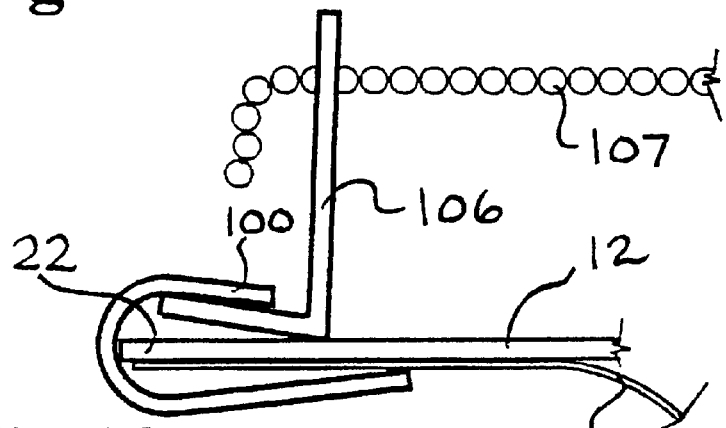

FIG. 20 shows an extrusion 106, of an L-shaped cross-section, engaged between the flange 100 and the backing sheet 12 to rigidify, straighten and tighten the backing sheet and poster assembly over its length when necessary. The extrusion 106 may be one of a pair of such extrusions, provided at opposite sides of the backing sheet and interconnected by a chain 107, only one of these extrusions being shown in the drawings.

Figure 21:
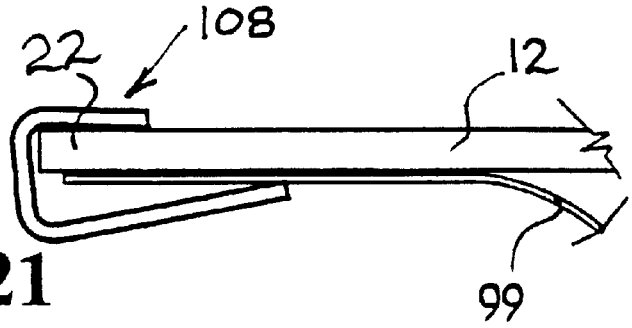
Figure 22:
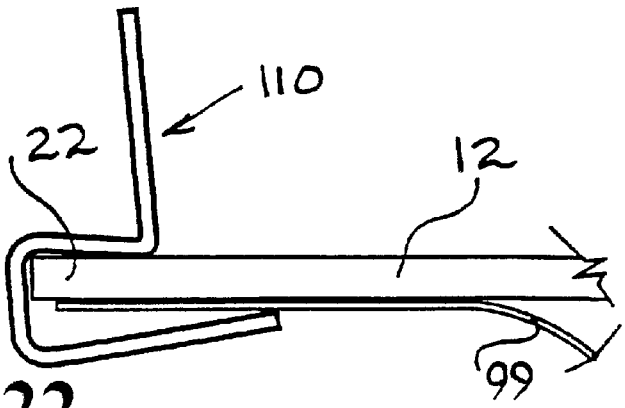

FIGS. 21 and 22 show two modifications of the extrusion 98, which are indicated generally, by reference numerals 108 and 110.

FIG. 23 shows an assembly of three curved panel assemblies which are indicted by reference numerals 10A, 10B, 10C, respectively, and which are connected together at the second opposite module edge portions of their backing sheets by connecting strips, one of which is indicated by reference numeral 112 and will described in greater detail below with reference to FIG. 38.

The curved panel assemblies 10A, 10B, and 10C are, for convenience of illustration shown in FIG. 23, with transparent backing sheets, and are arranged in a triangular array which, as viewed from above, appears as shown in FIG. 26.

FIGS. 24, 25, 27 and 28 show four other possible overhead views illustrating other arrangements in which the three curved panel assemblies 10A, 10B and 10C may be connected to one another.

Figure 29:
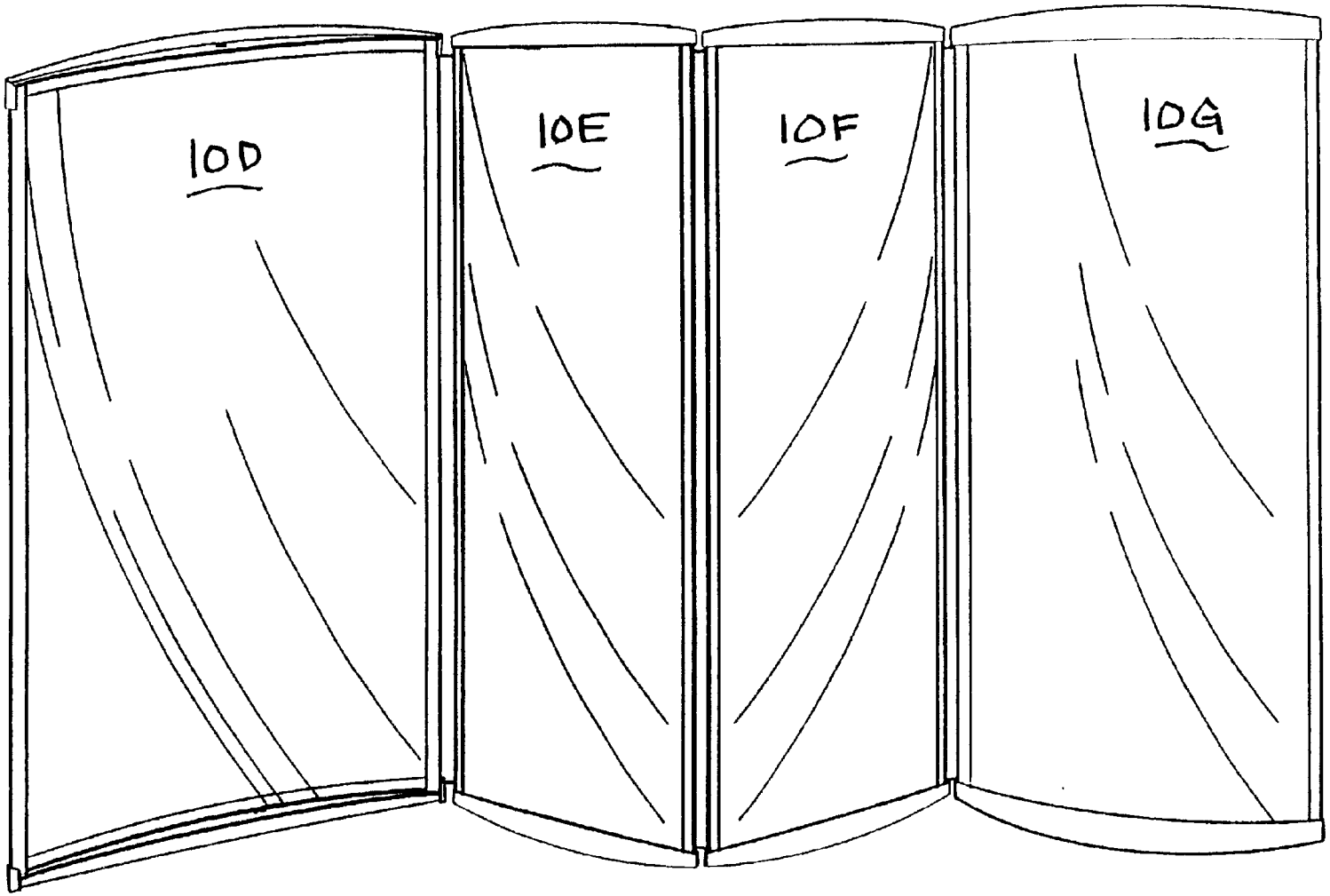
FIG. 29 shows a further assembly of four curved panel assemblies such as that of FIG. 1.
Figure 30:
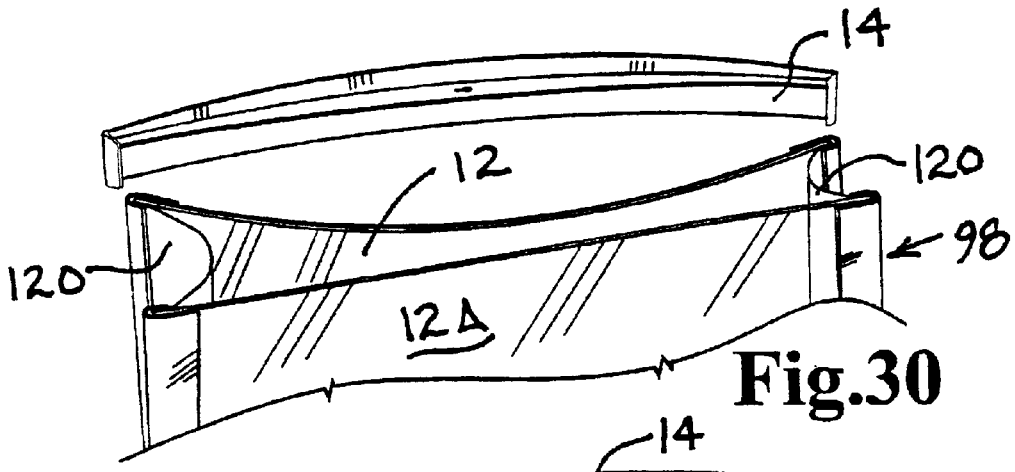
FIGS. 30 to 33 show four successive steps in the assembly of a parallel curved panel assembly such as that of FIG. 1.

FIG. 29 shows an assembly of four curved panel assemblies 10D–10G, which are each similar to the curved panel assembly 10 of FIG. 1, and which may be used, for example, to provide a room divider or a vertical display assembly. It is also possible to combine a pair of curved panel assemblies, such as that of FIG. 1, in a double curved panel assembly, as illustrated in FIGS. 30 to 33.

For this purpose, the backing sheet 12 of FIG. 1 is firstly connected to a similar backing sheet 12A by pair of edge connecting strips 120, which have opposite longitudinal edges engaged between the backing sheets 12 and 12A and their reinforcement extrusions 98.

Figure 31:
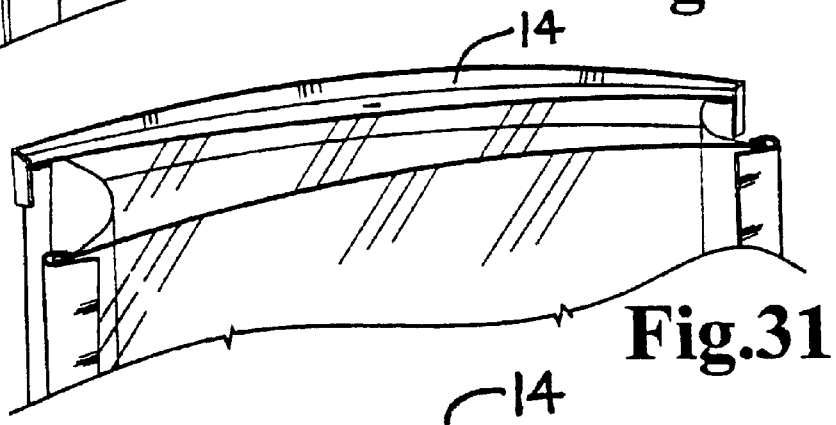

The backing sheet 12 is then engaged as shown in FIG. 31 with its abutment members 14, only one of which is shown, in FIGS. 30 through 33.

Figure 32:
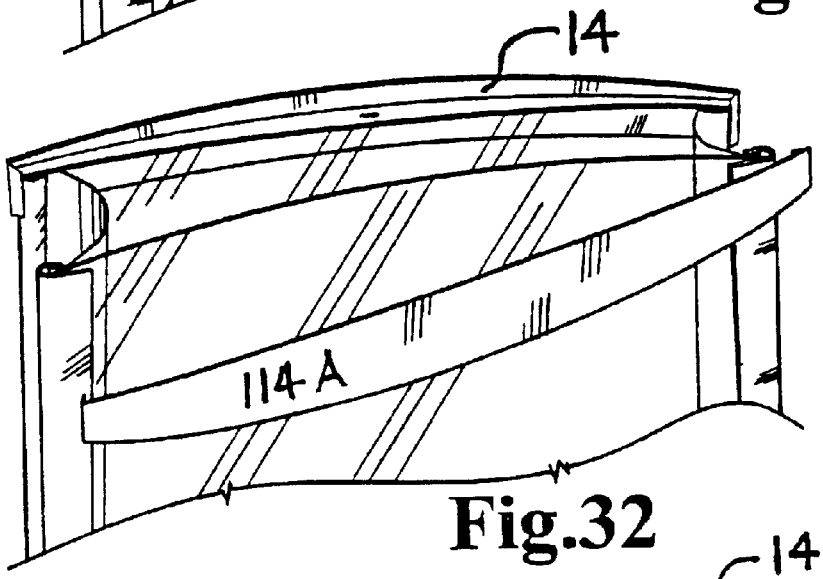
Figure 33:
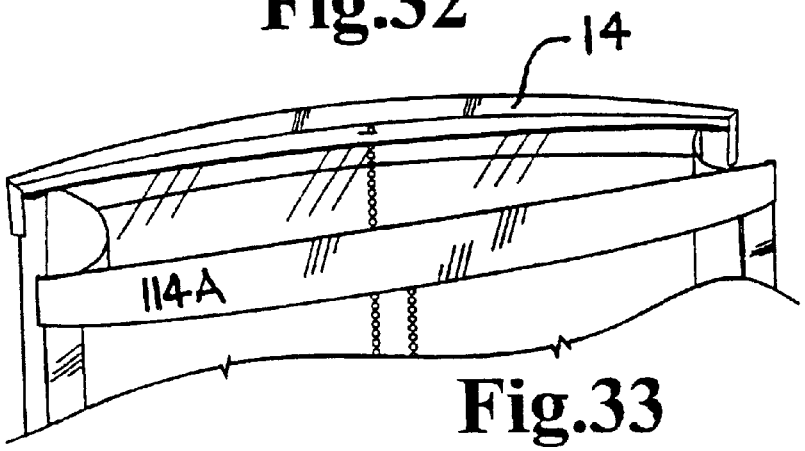

Then, a further pair of abutment members, which are identical to the abutment members 14 and of which only one is shown in FIGS. 32 and 33 and is indicated by reference numeral 114, is assembled with the backing sheet 12A.

Figure 34:
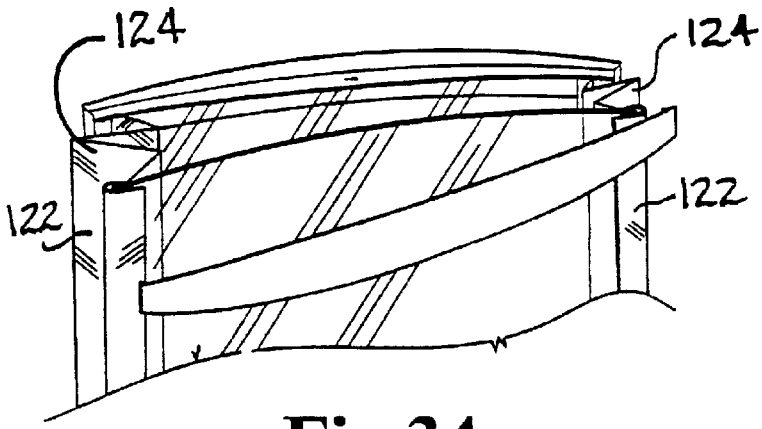
FIG. 34 shows a broken-away view, in perspective, corresponding to FIG. 32 but of a modified assembly.

The connecting strips 120, forming side walls of opposite sides of the double curved panel assembly thus formed, may be replaced by connecting strips 122 (FIG. 34), which are formed with longitudinally extending concertina folds 124, to enable the spacing between the backing sheets 12 and 12A and their associated abutment members 14 and 114 to varied, as required.

Figure 35:
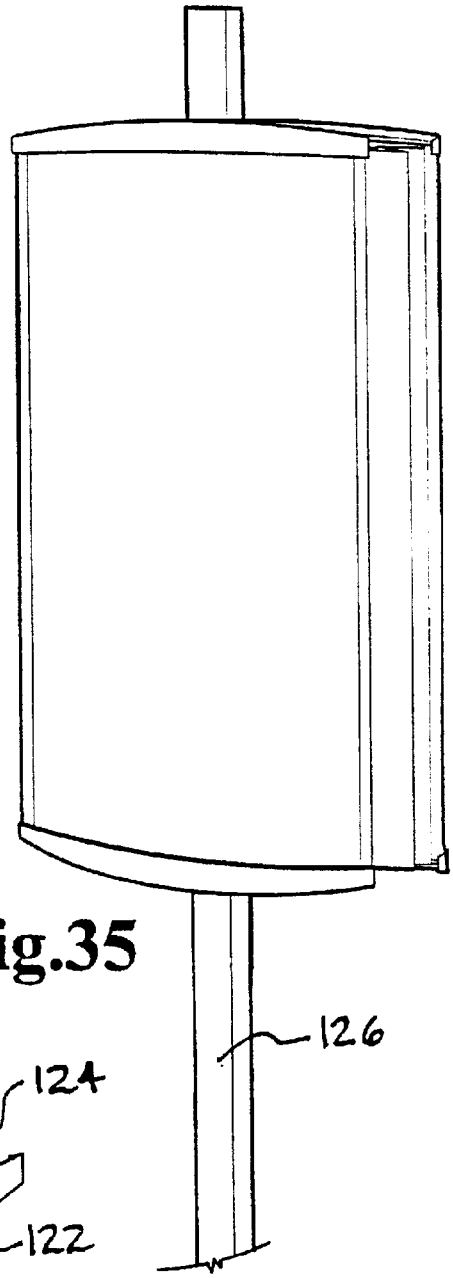
FIG. 35 shows a view of a double curved panel assembly mounted on a post.

FIG. 35 shows a double curved panel assembly, incorporating the connecting strips 122, mounted on a post 126, which extends vertically between the backing sheets 12 and 12A and their associated abutment members 14 and 114.

Figure 37:
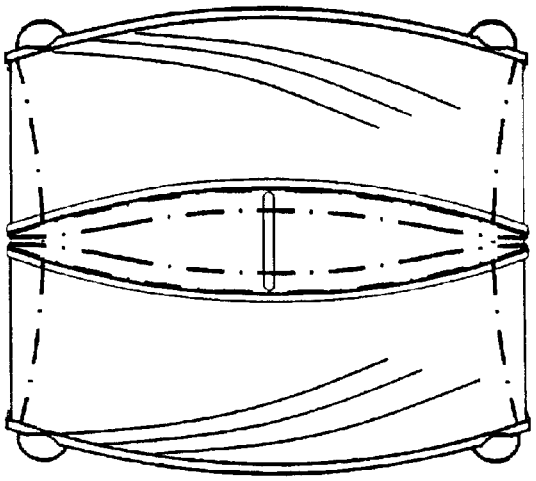
FIG. 37 shows a plan view of the double curved panel assembly of FIG. 36.
Figure 36:
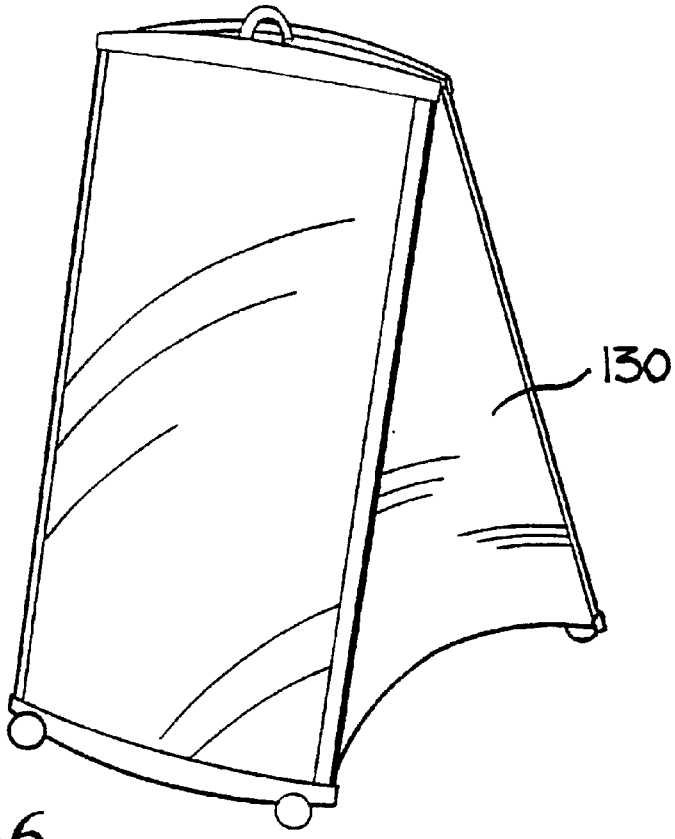
FIG. 36 shows a view in perspective of a double curved panel assembly.

A further variation of the above-described double curved panel assembly is shown in FIGS. 36 and 37. In this case, the opposite side walls of the double curved panel assembly are formed by connecting pieces of 130 of generally triangular shape, which allow the double curved panel assembly to diverge downwardly, as shown in FIG. 36.

Figure 38:
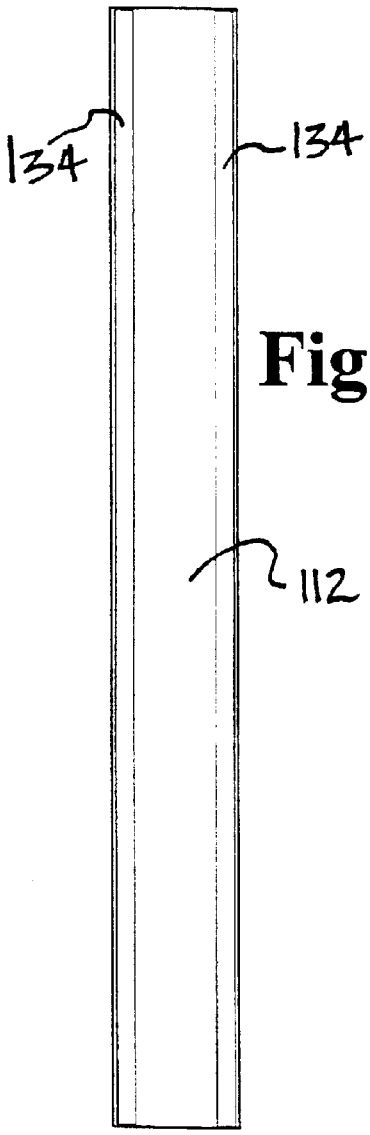
FIG. 38 shows a view in plan view of a connecting strip.

The above-mentioned connecting strip 112 is shown in greater detail in FIG. 38 and comprises a strip of sheet material having opposite parallel longitudinal edges provided with strips of double sided adhesive tape to facilitate connection of the connecting strip 112 to the backing sheets of adjacent curved panel assemblies. The connecting strip 120 of FIGS. 30 to 33 is similar to connecting strip 112 and, therefore, is not described in greater detail herein.

Figure 39:
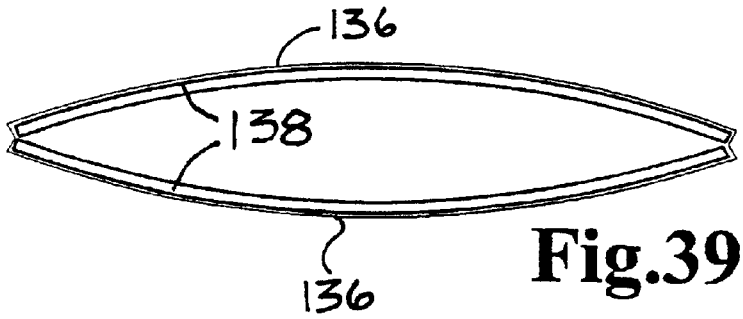
FIG. 39 shows a plan view of a cover.

FIG. 39 shows a cover member of sheet material having convexly curved opposite edges 136 provided with strips of double sided adhesive tape 138 which can be used to secure the cover to the abutment members at the top of one of the above-described double curved panel assemblies, for example to the abutment members 14 and 114 of FIGS. 32 and 33, to cover the space between the backing sheets of the two curved panel assemblies.

Figure 40:
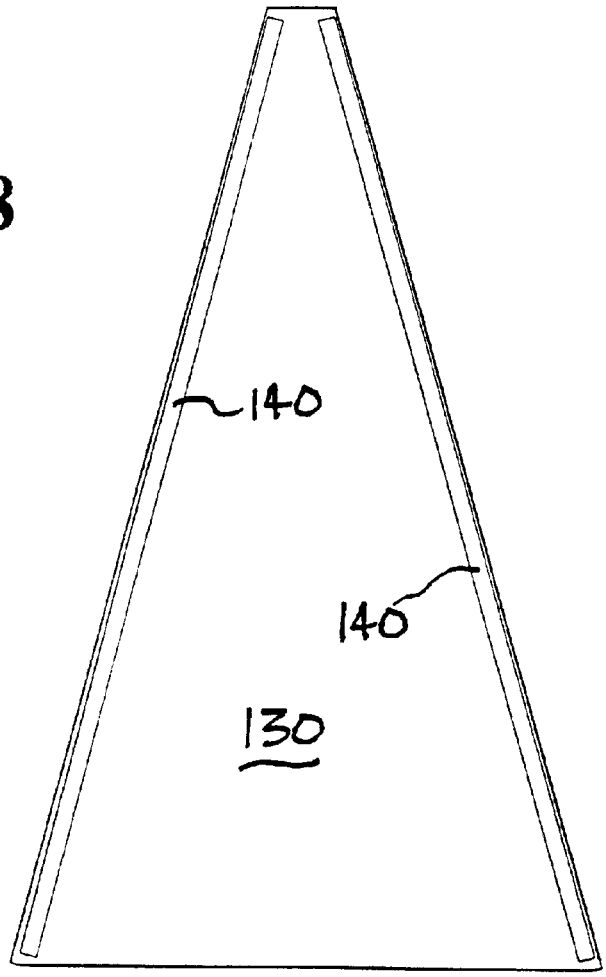
FIG. 40 shows a view inside elevation of a triangular connecting strip.

The side wall 130 of the double curved panel assembly of FIG. 36 is shown in greater detail in FIG. 40 and comprises a generally triangularly shaped sheet of flexible material provided, along its opposite divergent edges, with strips 140 of double sided adhesive tape for attaching the side wall 130 to its curved panel assemblies.

As will be appreciated by those skilled in the art, various other modifications may be made in the above-described embodiments of the invention within the scope of the appended claims.

What is claimed is:

1. A curved panel assembly, comprising:

upper and lower elongate curved abutment members;

said abutment members each having an elongate concave rear side;

backing sheet retainers extending rearwardly from said concave rear side at opposite ends of said concave rear side, said backing sheet retainers having a predetermined spacing from one another;

a backing sheet;

said backing sheet having first opposite marginal edge portions facing and abutting said concave rear sides of said abutment members and second opposite marginal edge portions retained by said backing sheet retainers;

said first opposite marginal edge portions each having a length greater than said predetermined spacing of said backing sheet retainers and said backing sheet being sprung into abutment against said rear sides of said abutment members with said second opposite marginal edge portions retained by said backing sheet retainers; and said abutment members being rearwardly open behind said first opposite marginal edge portions of said backing sheet so as to allow said backing sheet to be displaced to and fro perpendicular to said concave rear side.

2. A curved panel assembly as claimed in claim 1, wherein said backing sheet retainers each comprise flanges on said abutment members, said flanges forming, with said concave rear side of said member, pairs of opposed concave recesses at the opposite ends of said rear sides and said opposed concave recesses receiving said second opposite marginal edge portions of said backing sheet.

3. A curved panel assembly as claimed in claim 1, wherein said abutment members have backing sheet retainer abutments extending rearwardly from said abutment members past said first opposite marginal edge portions of said backing sheet.

4. A curved panel assembly as claimed in claim 1, wherein said abutment members each have a T-shaped cross-sections said T-shaped cross-section being formed by a curved flange, said concave side forming a concave rear face on said curved flange, and a flat flange projecting rearwardly from said concave rear face, said first opposite marginal portions of said backing sheet being accommodated between and retained by said flat flanges.

5. A curved panel assembly as claimed in claim 4, wherein said backing sheet retainers each comprise a flange on the respective one of said abutment members, said flanges forming with said rear side of said member a pair of opposed concave recesses at the opposite ends of said rear side and said opposed concave recess receiving said second opposite marginal edge portions of said backing sheet.

6. A curved panel assembly as claimed in claim 1, further comprising an elongate resilient retainer stretched between said abutment members, said resilient retainer having opposite ends in releasible engagement with said abutment members.

7. A curved panel assembly as claimed in claim 1, further comprising elongate edge covers each extending along and engaged over said second opposite marginal edge portions of said backing sheet from one to the other of said abutment members.

8. A curved panel assembly as claimed in claim 1, further comprising a curved support rod, said abutment members and opposite ends of said support rod having mutually releasibly engageable portions.

9. A curved panel assembly as claimed in claim 1, wherein said abutment members each comprises a curved front plate and a backing sheet abutment formed separately from said front plate.

10. A curved panel assembly as claimed in claim 9, wherein said abutment members are provided, at rear sides thereof, with formations shaped to engage and retain said backing sheet abutments.

11. A curved panel assembly as claimed in claim 9, wherein said front plates each have a curved rear side, a rib extending along said rear side and a rearwardly open recess in said rib, and said backing sheet abutments are engaged in said recesses.

12. A curved panel assembly as claimed in claim 11, wherein said backing sheet abutments each comprise a length of wire and a portion of said wire is engaged in a respective one of said recesses.

13. A curved panel assembly as claimed in claim 1, including a support bracket, said support bracket having a pair of suction cups for connection to a rear surface of said backing sheets.

14. A curved panel assembly as claimed in claim 13, wherein said support bracket comprises a length of metal bent to form a rear portion and a pair of arms extending at an inclination from said rear portion, said arms having free ends mounting said suction cups.

15. A curved panel assembly as claimed in claim 14, wherein said support bracket is one of a pair of similar support brackets.

16. A curved panel assembly as claimed in claim 15, including an elongate retainer member extending between and connected to said abutment members and said support brackets.

17. A curved panel assembly as claimed in claim 1, further comprising metal extrusions engaged with said second opposite marginal edge positions of said backing sheets.

18. A method of assembling a curved panel assembly, which comprises the steps of inserting opposite marginal edge portions of a backing sheet into retainers at opposite ends of a pair of curved abutment members having concave sides, with said backing sheet thereby having a concave shape facing said concave sides of said abutment members, and springing said backing sheet into abutment with said concave sides of said abutment members so as to thereby force said opposite marginal edge portions against said retainers and to form said backing sheet with a convex shape facing towards said concave sides of said abutment members, and to thereby releasibly connect said backing sheet and said retainers to one another.

19. An assembly comprising a pair of curved panel assemblies each comprising:

upper and lower elongate curved abutment members;

said abutment members each having an elongate concave rear side;

backing sheet retainers extending rearwardly from said concave rear side at opposite ends of said concave rear side, said backing sheet retainers having a predetermined spacing from one another;

a backing sheet;

said backing sheet having first opposite marginal edge portions facing and abutting said concave rear sides of maid abutment members and second opposite marginal edge portions retained by said backing sheet retainers;

said first opposite marginal edge portions each having a length greater than said predetermined spacing of said backing sheet retainers and said backing sheet being sprung into abutment against said rear sides of said abutment members with said second opposite marginal edge portions retained by said backing sheet retainers; and said abutment members being rearwardly open behind said first opposite marginal edge portions of said backing sheet so as to allow said backing sheet to be displaced to and fro perpendicular to said concave rear side;

a connection between said panel assemblies.

20. An assembly as claimed in claim 19, wherein said connection comprises a connecting strip having opposite longitudinal edges connected to said curved panel assemblies.

21. An assembly as claimed in claim 20, wherein said connecting strip is seared to one of said second opposite marginal edge portions of each of said backing sheets of said curved panel assemblies.

22. An assembly as claimed in claim 21, including an additional curved panel assembly similar to said first-mentioned curved panel assemblies and connected to at least one of said first-mentioned curved panel assemblies.

23. A curved panel assembly, comprising:

first and second upper and lower elongate curved abutment members;

said abutment members each having an elongate concave rear side;

backing sheet retainers extending rearwardly from said concave rear side at opposite ends of said concave rear side, said backing sheet retainers having a predetermined spacing from one another;

first and second backing sheets;

said first and second backing sheets having first opposite marginal edge portions facing and abutting said concave rear sides of respective one of said abutment members and second opposite marginal edge portions retained by said backing sheet retainers;

said first opposite marginal edge portions each having a length greater than said predetermined spacing of said backing sheet retainers and said first and second baking sheets being sprung into abutment against said rear sides of said abutment members with said second opposite marginal edge portions retained by said backing sheet retainers;

said abutment members being rearwardly open behind said first opposite marginal edge portions of said backing sheet so as to allow said backing sheet to be displaced to and fro perpendicular to said concave rear side; and a pair of side walls extending between said second marginal edge portions at respective opposite sides of said curved panel assembly.

24. A curved panel assembly as claimed in claim 23, wherein said side walls have concertina folders extending longitudinal of said side walls.

25. A curved panel assembly as claimed in claim 23, wherein said side walls each have opposite divergent longitudinal edges.

26. A curved panel assembly as claimed in claim 23, further comprising a cover extending between said upper abutment members and covering the top of a space between said backing sheets.

* * * * *